United States Patent [19]

Miyawaki et al.

[11] Patent Number: 4,906,894

[45] Date of Patent: Mar. 6, 1990

[54] PHOTOELECTRON BEAM CONVERTING DEVICE AND METHOD OF DRIVING THE SAME

[75] Inventors: Mamoru Miyawaki, Tokyo; Yukio Masuda, Atsugi; Ryuichi Arai; Nobutoshi Mizusawa, both of Sagamihara; Takahiko Ishiwatari, Yamato; Hitoshi Oda, Yokohama, all of Japan

[73] Assignee: Canon Kabushiki Kaisha, Tokyo, Japan

[21] Appl. No.: 331,007

[22] Filed: Mar. 28, 1989

Related U.S. Application Data

[63] Continuation of Ser. No. 185,316, Apr. 20, 1988, abandoned, which is a continuation of Ser. No. 60,929, Jun. 12, 1987, abandoned.

[30] Foreign Application Priority Data

Jun. 19, 1986 [JP] Japan ..... 61-141234
Jun. 19, 1986 [JP] Japan ..... 61-141235
Jun. 19, 1986 [JP] Japan ..... 61-141236

[51] Int. Cl.[4] ..... H01J 40/06; H01J 40/16

[52] U.S. Cl. ..... 313/542; 313/499; 313/501; 313/507; 313/523; 313/366; 313/373; 313/380; 313/384; 313/385; 357/30

[58] Field of Search ..... 313/366, 367, 373, 380, 313/384, 388, 499, 501, 507, 523, 531, 539, 542; 357/17, 30 A, 30 D, 3 F; 250/292.24

[56] References Cited

U.S. PATENT DOCUMENTS

| | | | |
|---|---|---|---|
| 3,343,026 | 9/1967 | Luechinger et al. | 313/499 |
| 3,809,941 | 5/1974 | Bourg et al. | 313/542 |
| 3,845,296 | 10/1974 | Schnitzler | 313/373 X |
| 3,914,136 | 10/1975 | Kressel | 313/542 X |
| 3,922,579 | 11/1975 | Goto et al. | 313/366 |
| 3,970,887 | 7/1976 | Smith et al. | 313/366 X |
| 4,095,133 | 6/1978 | Hoebrechts | 313/336 |
| 4,096,511 | 6/1978 | Gurnell et al. | 313/542 X |
| 4,259,678 | 3/1981 | Van Gorkom et al. | 357/13 |
| 4,303,930 | 12/1981 | Van Gorkom et al. | 357/13 |
| 4,370,797 | 2/1983 | Van Gorkom et al. | 313/366 X |
| 4,460,831 | 7/1984 | Oettinger et al. | 313/542 X |
| 4,644,221 | 2/1987 | Gutierrez et al. | 313/384 X |
| 4,797,890 | 11/1989 | Inaba et al. | 313/499 X |

FOREIGN PATENT DOCUMENTS

| | | |
|---|---|---|
| 30274 | 3/1979 | Japan . |
| 111272 | 8/1979 | Japan . |
| 15529 | 2/1981 | Japan . |
| 38528 | 3/1982 | Japan . |

*Primary Examiner*—Donald J. Yusko
*Assistant Examiner*—Michael Horabik
*Attorney, Agent, or Firm*—Fitzpatrick, Cella, Harper & Scinto

[57] ABSTRACT

A photoelectron beam converting device including a semiconductor substrate having a p-n junction formed between an n-type region and a p-type region and an opening portion formed on the side of the semiconductor substrate. An electron beam is generated by a light which enters from the opening portion and by a reverse voltage to be applied to the p-n junction.

2 Claims, 8 Drawing Sheets

PHOTOELECTRON BEAM CONVERTING DEVICE AND METHOD OF DRIVING THE SAME

This application is a continuation of application Ser. No. 07/185,316 filed Apr. 20, 1988 which is a continuation of Ser. No. 07/060,929 filed June 12, 1987, both now abandoned.

BACKGROUND OF THE INVENTION

1. Field of the Invention

The present invention relates to a photoelectron beam converting device and, more particularly, to a photoelectron beam converting device for use in a solid-state electron beam generating apparatus and to a method of driving such a device.

2. Related Background Art

As a solid-state electron beam generating apparatus, there has been known an apparatus in which an electric field is applied to a hetero junction formed in a semiconductor, thereby allowing an electron beam to be emitted from the surface of the semiconductor to the outside.

For example, in Japanese Patent Publication No. 30274/1979, there has been disclosed an apparatus in which a forward voltage is applied to the n-p junction formed in the mixed crystal of AlP and GaP, thereby allowing the electrons to be emitted from the surface of a p-type region. In Japanese Patent Application Laid-open No. 111272/1979, there has been disclosed a solid-state electron beam generating apparatus in which a reverse voltage is applied to the p-n junction at least a part of which is exposed in the opening formed in an insulating layer of the surface of a semiconductor and an accelerating electrode is provided for the insulating layer until the edge of the opening. On the other hand, in Japanese Patent Application Laid-open No. 15529/1981, there has been disclosed a semiconductor apparatus in which an accelerating electrode is provided for the edge portion of the opening portion formed in an insulating layer of the surface of a semiconductor, and a reverse voltage is applied to the p-n junction which extends in the opening in parallel with the surface of the semiconductor, thereby allowing the electrons to be emitted to the outside of the semiconductor. In addition, an electron beam generating apparatus laminated on the semiconductor substrate has been disclosed in each of Japanese Patent Application Laid-open No. 111272/1979 and Japanese Patent Application Laid-open No. 15529/1981. On the other hand, in Japanese Patent Application Laid-open No. 38528/1982, there has been disclosed a multi cool electron emitting cathode in which a device for emitting the electrons from the surface of a semiconductor by applying a forward bias voltage to the p-n junction is laminated on the semiconductor substrate.

Those solid-state electron beam generating apparatuses have many advantages such that the sizes are small, the emission of the electrons can be modulated by the voltage which is applied to the p-n junction, and the like. An apparatus which is constituted by arranging a plurality of electron beam generating devices is considered by use of the advantage of miniaturization. However, another problem occurs because the wirings to drive the electron beam generating apparatus are complicated.

On the other hand, in D. J. Barteling, J. L. Moll, N.I. Meyer, et al., "Phys. Rev. "Vol. 130, No. 3 (1963), pages 972 to 985, they have reported that in the case where a reverse voltage is applied to the p-n junction and the electron avalanche is caused to thereby generated the electrons, the light is irradiated to the p-type region and the electrons are excited, thereby enabling the electron beam to be driven. However, according to this method, the light to excite the electrons enters from the electron beam emitting side. Therefore, if this method is applied to the apparatus using the electron beam such as electron beam converting device or the like, a structure of the apparatus becomes complicated, causing a problem in manufacturing of the apparatus.

SUMMARY OF THE INVENTION

It is an object of the present invention to provide a photoelectron beam converting device which can solve the problems in the foregoing conventional techniques and can generate an electron beam by entering the light to excite the electrons to the p-n junction which are reversely biased with a simple constitution.

To accomplish this object, the photoelectron beam converting device according to the invention generates the electron beam by entering the light to excite the electrons to the reversely-biased p-n junction from the portion other than the electron beam emitting side.

According to an embodiment of the invention, there is provided a photoelectron beam converting device including a semiconductor substrate having a p-n junction formed between the n-type region and the p-type region, wherein an opening portion is formed on the side of the semiconductor substrate and the electron beam is generated by the light which enters from the opening portion and by the reverse voltage which is applied to the p-n junction. Therefore, by entering the light from the opening portion formed on the substrate side and by applying the reverse voltage to the p-n junction, an electron beam is generated, so that the electron beam can be easily generated by the photosignal.

According to another embodiment of the invention, the photoelectron beam converting device includes a semiconductor substrate having a p-n junction formed between the n-type region and the p-type region, wherein a power source to apply a reverse bias voltage to the p-n junction and a photoconductive layer formed on the substrate are serially connected. As described above, by providing the photoconductive film on the substrate side, by entering the light to this film, and by applying the reverse bias voltage to the p-n junction, the electron beam is generated, so that the electron beam can be easily driven by the light. Further, as the light for the input signal, the light of a wavelength of a wide range can be used.

According to still another embodiment of the invention, in a method of driving a multi-electron beam generating apparatus, a multi-electron beam generating apparatus has a plurality of p-n junctions formed by providing a plurality of p-type regions on the semiconductor substrate and then providing an n-type region on each of these plurality of p-type regions, an opening portion is formed at the position corresponding to each of the plurality of p-n junctions of the substrate, a transparent electrode is formed on the whole surface of the substrate, a common electrode is formed on the plurality of n-type regions, the reverse voltage is applied between the transparent electrode and the common electrode, the light enters from the opening portion, and thereby allowing the electron beam to be generated from the semiconductor surface on the side opposite to the light incident region.

Therefore, by addressing the multi-electron beam generating apparatus, the wirings to generate the electron beam is extremely simplified and the electron beam can be driven in a contactless manner.

DETAILED DESCRIPTION OF THE PREFERRED EMBODIMENTS

An embodiment of the present invention will be described hereinbelow with reference to the drawings.

Figure 1:
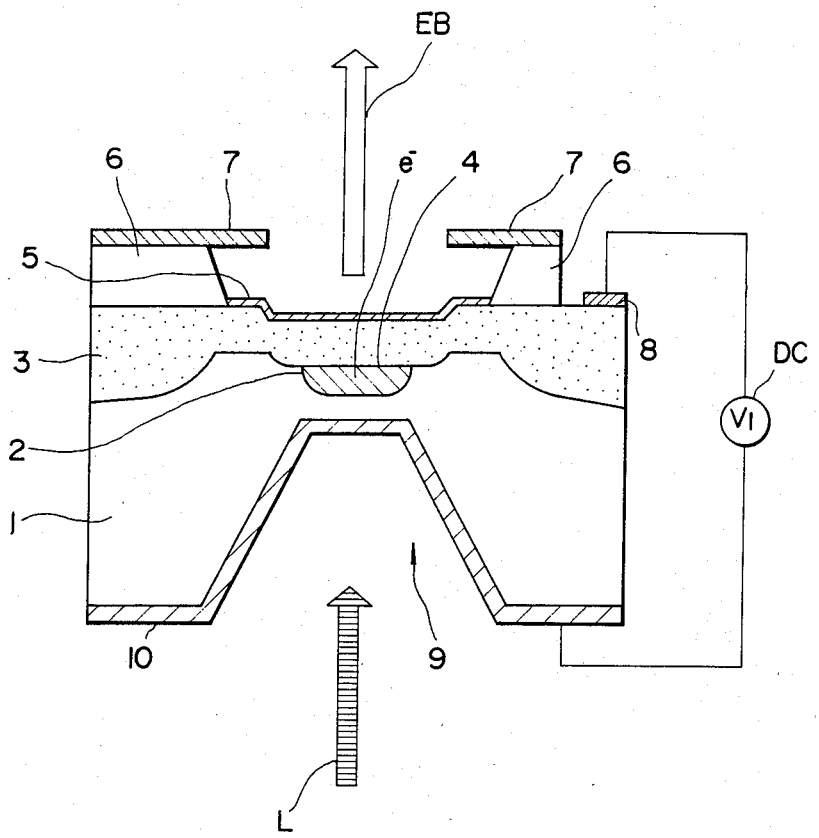
FIG. 1 is a cross sectional view of a photoelectron beam converting device according to the first embodiment of the present invention.

FIG. 1 is a diagram showing a cross-sectional view of the device according to the first embodiment of the invention, in FIG. 1, reference numeral 1 denotes a p-type Si substrate; 2 is a high concentration dope p-type region; 3 an n-type region; 4 a p-n junction; 5 a material to reduce the work function such as, e.g., a cesium (Cs) thin film or the like; 6 an insulating layer such as, e.g., silicon dioxide ($SiO_2$) or the like; 7 an electron accelerating electrode; 8 an electrode; 9 an opening portion formed on the substrate side of the p-type region 2; and 10 a transparent electrode consisting of $SiO_2$, ITO, or the like. Such a device can be manufactured by the ordinary semiconductor lithography technique.

The principle of the operation of the device of the embodiment will now be described. In this device, a reverse bias voltage is applied to the p-n junction by a drive circuit DC. The applied voltage is set to be slightly lower than the level of the threshold electric field at which the electron avalanche starts occurring. As shown in FIG. 1, the incident light L from the opening portion on the back side of the p-type region 2 is transmitted through the transparent electrode 10, thereby exciting the electrons in the p-type region 2. The excited electrons becomes a trigger to cause the electron avalanche. The electrons are transmitted through the n-type region 3 and are further accelerated by the electric field generated by the accelerating electrode 7, so that an electron beam EB is emitted. A material such as cesium or the like to reduce the work function is deposited by evaporation on the surface of the n-type region 3 and the electrons of a low energy can be also emitted.

The second embodiment of the invention will now be described with reference to FIG. 2. The second embodiment differs from the first embodiment with respect to the point that the p-type Si substrate 1 is etched until the high concentration p-type region 2. The operating principle of the second embodiment is similar to the first embodiment. In the case of the second embodiment, the light L serving as a trigger to generate the electron beam is directly irradiated onto the p-type region 2, so that the generating efficiency of the electron beam rises. Further, since the interval between the electrodes to apply a reverse bias voltage is narrow, there are advantages such that it is sufficient to use a low driving voltage and the like.

As a method of etching until the p-type region 2 of the substrate 1, the following two methods are considered: one is a method of performing the wet etching by an admixture consisting of hydrofluoric acid and nitric acid through a mask; and the other is a method of performing the reactive ion etching using the $Cl_2$ gas. Since the interval between the substrates is so thick to be about 500 $\mu$m, if the etching process is not finished by a single masking forming process, it is sufficient to repeat the mask forming and etching processes a few times.

It will be understood that a compound semiconductor can be also used in place of Si in the foregoing first and second embodiments.

Figure 2:
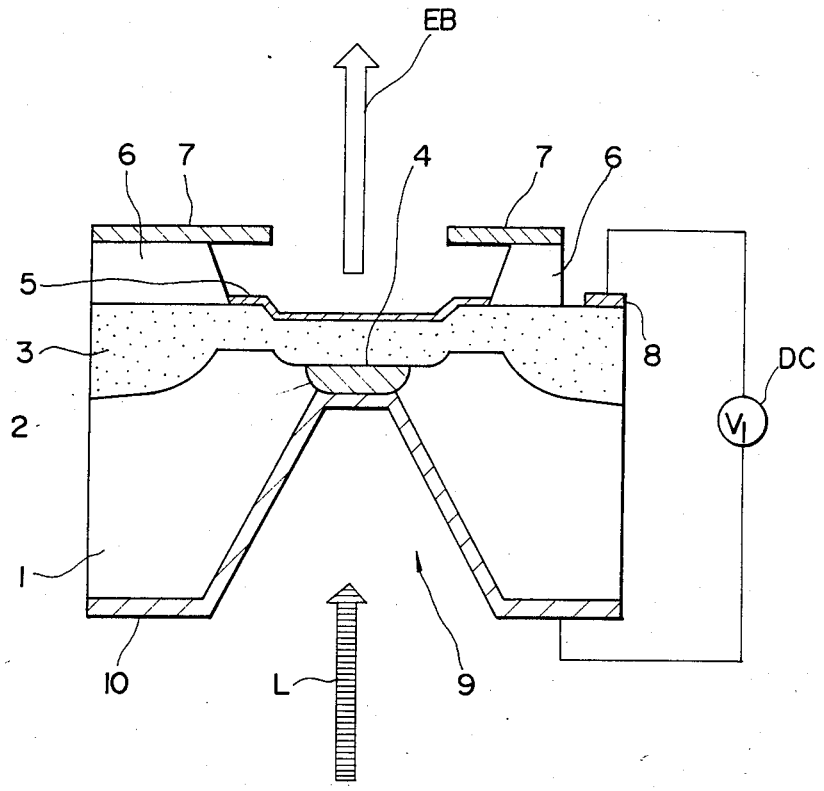
FIG. 2 is a cross sectional view of a photoelectron beam converting device of the second embodiment of the invention.

Since the structures of the devices shown in FIGS. 1 and 2 are simple, a plurality of devices can be integrated on the single substrate.

Figure 3:
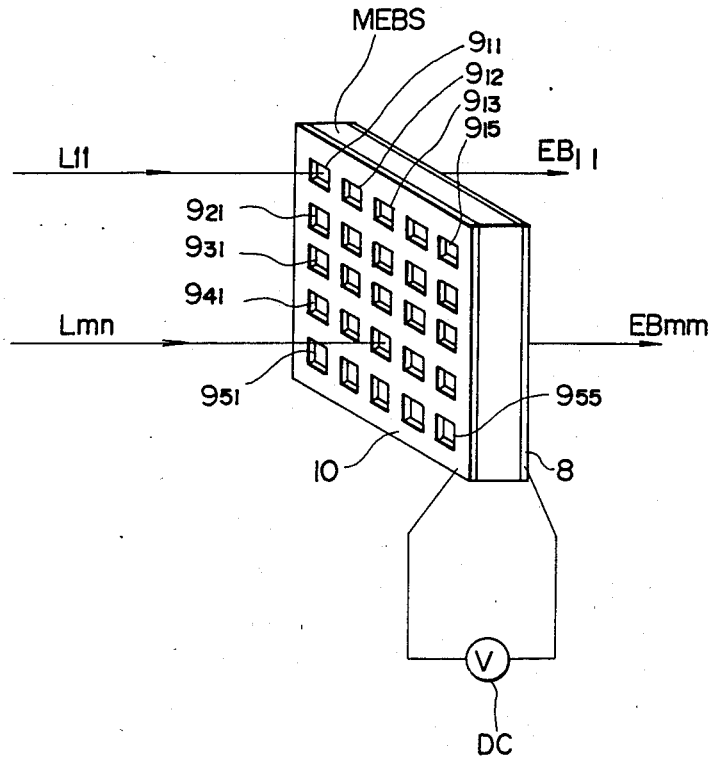
FIG. 3 is a perspective view showing the third embodiment of the invention.

The third embodiment of the invention will now be explained with reference to FIG. 3.

The third embodiment relates to an MEBS which is constituted by arranging a plurality of photoelectron beam converting devices shown in the first or second embodiment. Hitherto, in the case where a plurality of those photoelectron beam converting devices are integrated and each of these devices is independently driven, the wirings to connect the devices are complicated, so that the realization of high integration is obstructed. In the case of this device, the common transparent electrode 10 is provided on the light incident side of each of a plurality of photoelectron beam converting devices MEBS; on the other hand, a common electrode 8 is merely provided in the n-type region on the emitting side of the electron beam. Reference numerals $9_{11}$, $9_{12}$ . . . , $9_{21}$, $9_{22}$, . . . , $9_{55}$ indicate opening portions each corresponding to the electron beam source. A reverse voltage which is slightly lower than the voltage at which the electron avalanche occurs is applied between the common transparent electrode 10 and the common electrode 8. Each electron beam is emitted when the light enters the opening portion on the substrate side corresponding to the electron beam source. As shown in FIG. 3, an electron beam $EB_{11}$ is emitted from the electron beam generating device to which the light $L_{11}$ entered. Similarly, an electron beam $EB_{mn}$ is emitted for the light $L_{mn}$.

As described above, in the apparatus of the type for generating an electron beam by causing the electron avalanche, an opening portion is formed on the substrate side and the light enters through this open portion, and a reverse voltage is applied to the p-n junction, thereby causing an electron beam to be generated. Thus, there is an effect such that the electron beam can be easily generated by the photo signal. The photoelectron beam converting devices of the embodiments can be also applied to an optical switchboard or the like.

Figure 4:
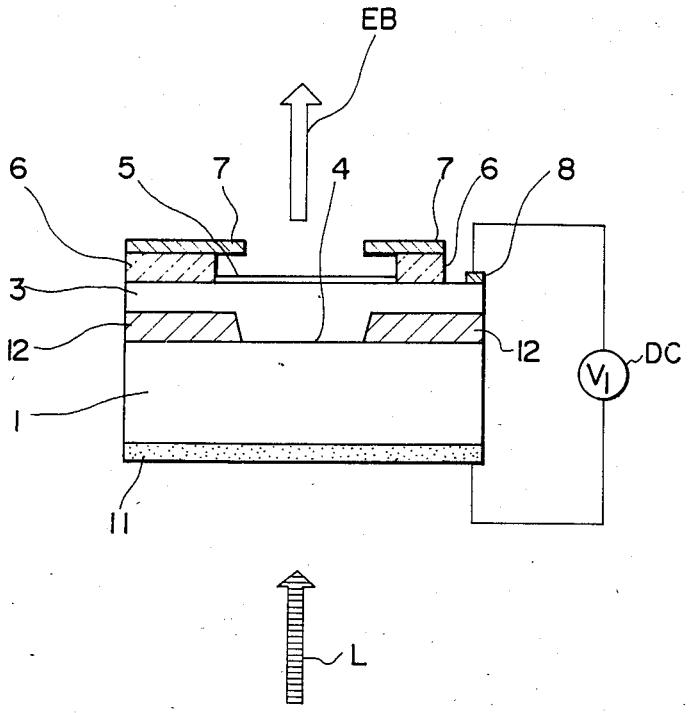
FIG. 4 is a cross sectional view of the fourth embodiment of a photoelectron beam converting device of the invention.

FIG. 4 is a diagram showing a cross-sectional view of a device according to the fourth embodiment of the invention. In FIG. 4, reference numeral 1 denotes the high concentration dope p-type Si substrate and 11 is a photoconductive film. For example, the film 11 is a made of non-dope hydrogenated amorphous silicon or the like. Numeral 12 denotes a non-dope Si layer; 3 the n-type region layers; 4 the p-n junction; 6 the insulating layer made of, e.g., silicon dioxide ($SiO_2$) or the like; 8 the electrode; 7 the electron accelerating electrode; and 5 the material to reduce the work function. For example, a cesium (Cs) thin film or the like may be used as the material 5. DC represents the drive circuit to apply a reverse bias voltage to the p-n junction of the device.

The operating principle of the device according to the fourth embodiment will now be described. In FIG. 4, the reverse bias voltage is applied to the p-n junction 4 by the drive circuit DC. When no light is irradiated onto the photoconductive film 11, the voltage drop occurs in the film 11 because the film 11 is in the high resistance state (about $10^{11}$ Ωcm), so that a reverse bias voltage enough to cause the electron avalanche in the p-n junction is not applied. On the contrary, when the light L is irradiated onto the film 11, the film 11 enters the low resistance state. Thus, a high enough reverse bias voltage is applied to the p-n junction 4 and the electron avalanche occurs. The excited electrons are transmitted through the n-type region and are further accelerated by the electric field generated by the accelerating electrode 7, so that the electron beam EB is emitted. The material such as cesium or the like to reduce the work function is evaporation deposited on the surface of the n-type region. The electrons of a low energy can be also emitted. On the other hand, the high concentration dope p-type substrate 1 is used as a substrate of the device. Therefore, the voltage drop between the substrate 1 and the photoconductive film 7 is small. If hydrogenated amorphous Si is used as a photoconductive film the lights in the visible ray range can be used. Therefore, the lights of wavelengths of a wide range can be used to input the signal.

Figure 5:
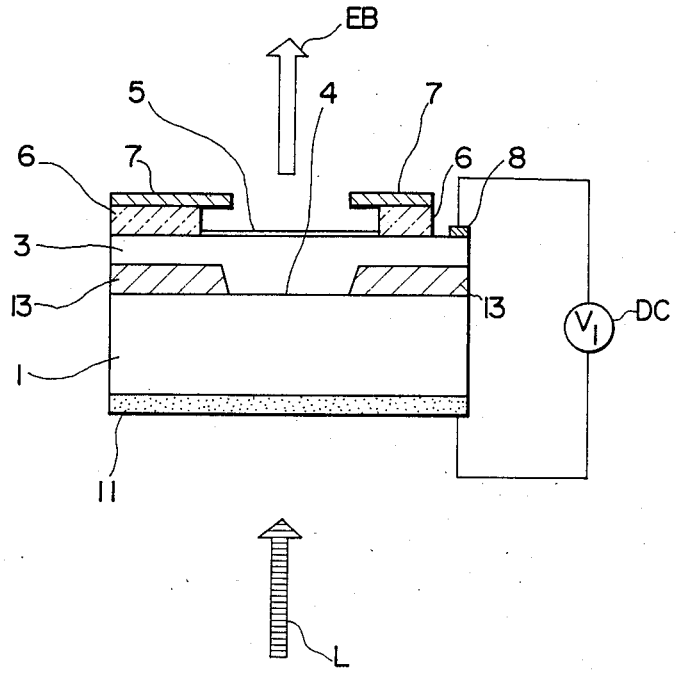
FIG. 5 is a cross sectional view of the fifth embodiment of a photoelectron beam converting device of the invention.

The fifth embodiment of the invention will now be described with reference to FIG. 5. The fifth embodiment relates to the device in which the non-dope Si layer 12 in the fourth embodiment was replaced by an insulating layer 13. As compared with the fourth embodiment, the electric field of the portion (namely, the insulating layer portion 13 between the n-type region 3 and the high concentration dope p-type substrate 1) other than the p-n junction 4 is smaller, thereby enabling the electron avalanche to be effectively caused in the p-n junction 4.

Figure 6:
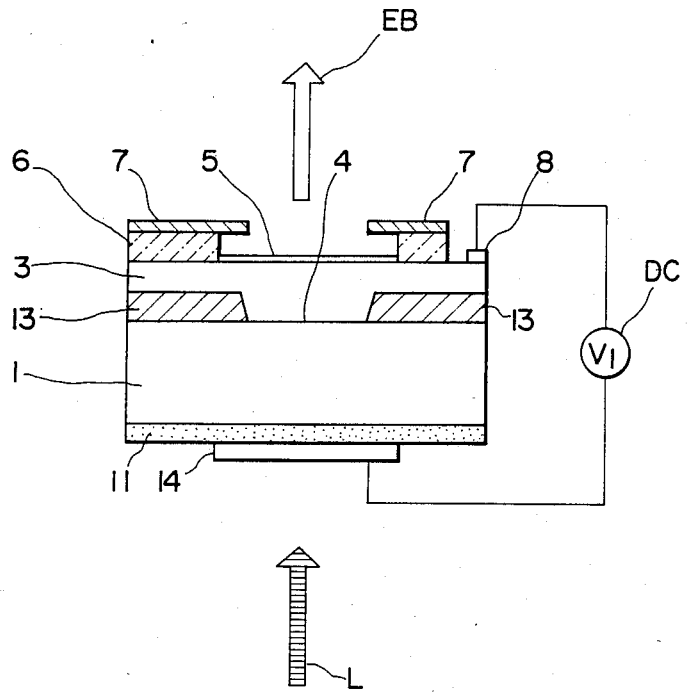
FIG. 6 is a cross sectional view of the sixth embodiment of a photoelectron beam converting device of the invention.

The sixth embodiment of the invention will now be described with reference to FIG. 6. the sixth embodiment has a structure such that a transparent electrode 14 consisting of $SnO_2$, ITO, or the like is formed on the photoconductive film 11 in the fifth embodiment. In the cases of the fourth and fifth embodiments, the light L is irradiated onto the photoconductive film 11 and the resistance thereof is reduced, thereby applying a voltage to the p-n junction 4. Therefore, when the light L is irradiated onto the portion including the connecting portion of the wiring from the drive circuit DC on the film 11, the normal operation to emit the electron beam is performed. However, if the light L is irradiated onto the photoconductive film 11 in the portion other than the above-mentioned portion, the resistance between the irradiated portion and the connecting portion is high, so that thereis a case where a reverse bias voltage enough to cause the electron avalanche is not applied to the p-n junction 4. To solve this problem, if the transparent electrode 14 is provided for the light irradiating region and the drive circuit DC is connected to the transparent electrode 14, even if the light L is irradiated onto any portion on the transparent electrode 14, and effective voltage is applied to the p-n junction 4 and the electron beam can be emitted by the light irradiation.

The photoelectron beam converting devices of the fourth to sixth embodiments mentioned above can be manufactured by the ordinary semiconductor lithography technique and their structures are relatively simple, so that they can be also integrated.

As described above, the photoconductive film is formed on the substrate side, the light is irradiated onto the photoconductive film, and a reverse bias voltage is applied to the p-n junction, thereby allowing the electron beam to be generated. Thus, the electron beam can be easily driven by the light. Further, there are effects such that lights of wavelengths in a wide range can be used as the light to input the signal and the like. The photoelectron beam converting device in this embodiment can be also applied to an optical switchboard or the like.

The seventh embodiment of the invention will now be described with reference to FIG. 7. In the seventh embodiment, a plurality of electron beam generating devices MEBS in the second or first embodiment are driven by use of an acoustic optical device.

Figure 7:
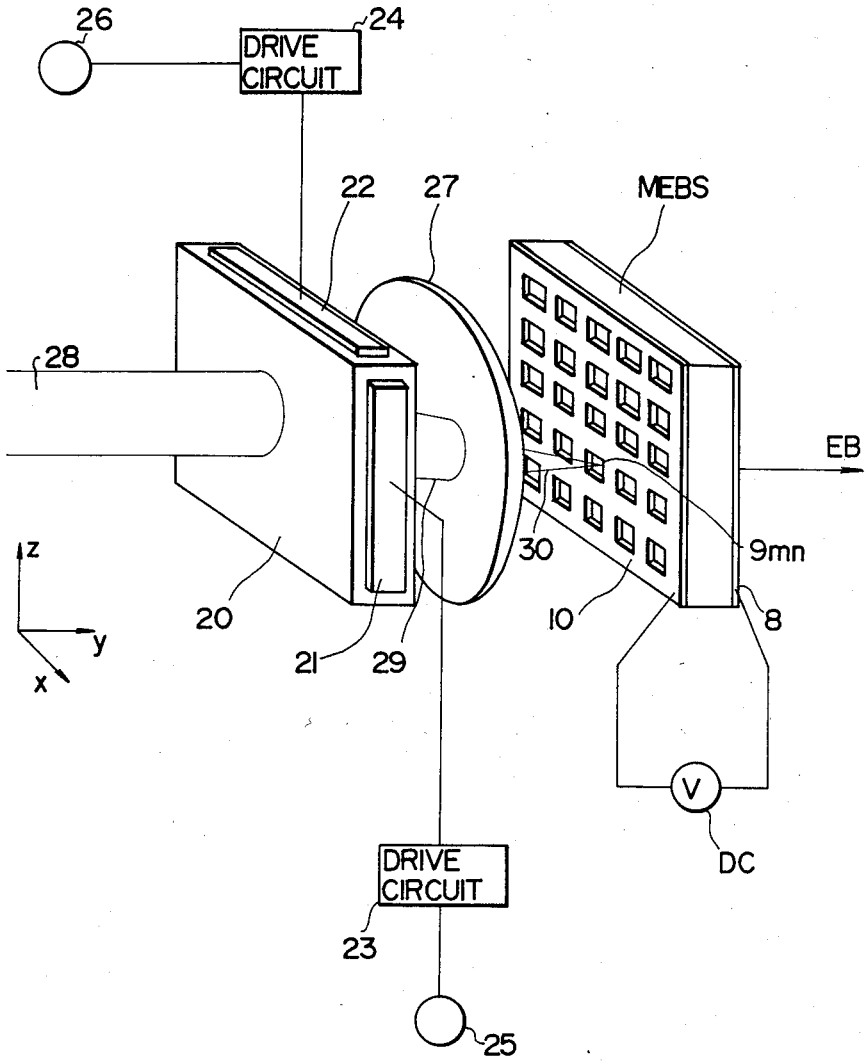
FIG. 7 is a perspective view showing the embodiment in FIG. 5.

In FIG. 7, reference numeral 8 denotes the common electrode provided on the emitting side of the electron beam of a plurality of electron beam generating device MEBS; 10 is the transparent electrode provided on the whole surface of the light input side; and DC is the drive circuit to generate the electron beam. Similarly to the first embodiment, a voltage which is slightly lower than the voltage at which the electron avalanche occurs between the transparent electrode 10 and the common electrode 8 is applied in the opposite direction to each p-n junction by use of the drive circuit DC. Numeral 20 denotes an acoustic optical device consisting of $As_2S_3$ glass, $Bi_{12}GeO_{20}$, $TiO_2$, or the like; 21 and 22 denote transducers attached in the directions perpendiculr to the x and z axes of the acoustic optical devices; 23 and 24 are drive circuits to supply an RF power to each of the transducers 21 and 22; 25 and 26 signal lines; and 27 a lens for focusing a laser beam to a plurality of photoelectron beam converting devices MEBS.

In FIG. 7, a driving method of emitting the electron beam EB from a plurality of electron beam generating devices MEBS will now be explained. The RF power of the frequency $f_m$ is applied from the signal source 25 through the drive circuit 23 to the transducer 21 of the acoustic optical device 20. On the other hand, the RF power of the frequency $f_n$ is applied from the signal source 26 through the drive circuit 24 to the transducer 22. Thus, an incident laser beam 28 to the acoustic optical device 20 is deflected in accordance with the input RF power, so that a diffracted light 29 is produced. The diffracted light 29 is converged by a lens 27 into the opening portion $9_{mn}$ in the transparent electrode 10 of an arbitrary cells $EBS_{mn}$ of the electron beam generating device MEBS from which the electron beam is emitted. The electron avalanche is caused by a converged light 30, so that the electron beam EB is emitted.

Figure 8:
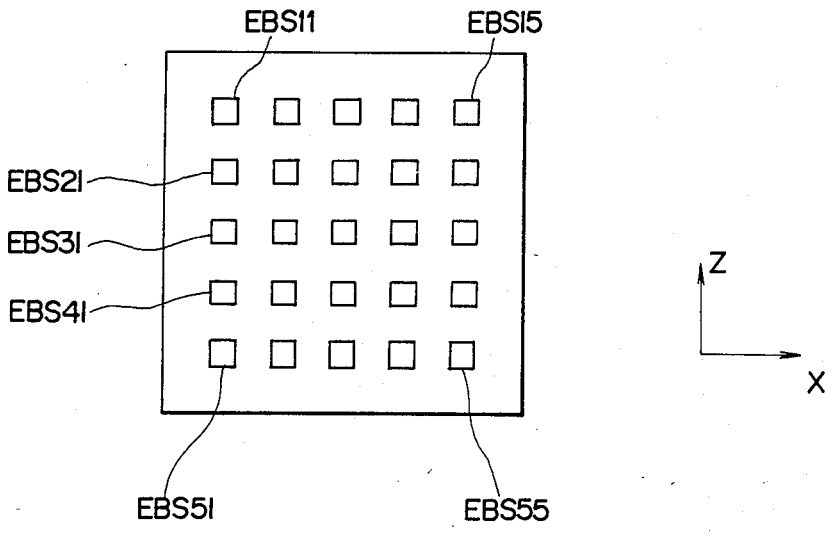
FIG. 8 is a plan view showing an arrangement of electron beam generating devices.

The combination of the frequency of the signal from the signal source 25 and the frequency of the signal from the signal source 26 corresponds to the address of the electron beam generating device MEBS which are two-dimensionally arranged in a one-to-one corresponding manner. Namely, in FIG. 8, in the case of generating an electron beam from the electron beam generating cell $EBS_{11}$, it is sufficient to generate the signals of the frequencies $f_1$ from the signal sources 25 and 26, respectively. Similarly, for the cell $EBS_{15}$, the frequency of the signal source 25 is set to $f_5$ and the frequency of the signal source 26 is set to $f_1$. For the cell $EBS_{51}$, the frequency of the signal source 25 is set to $f_1$ and the frequency of the signal source 26 is set to $f_5$. For the cell $EBS_{55}$, the frequencies of the signal sources 25 and 26 are set to $f_5$.

Further, in the case of generating electron beams at the positions of the cells $EBS_{11}$, $EBS_{21}$, $EBS_{31}$, $EBS_{41}$, and $EBS_{51}$, it is sufficient that the signals of the frequencies $f_1$, $f_2$, $f_3$, $f_4$, and $f_5$ from the signal sources 26 and the signal of the frequency $f_1$ from the signal source 25 are input to the transducers 22 and 21 of the acoustic optical device 20, respectively.

On the other hand, to simultaneously drive all of the electron beam cells, it is sufficient that the signals of the frequencies $f_1$, $f_2$, $f_3$, $f_4$, and $f_5$ from the signal source 25 and the signals of the frequencies $f_1$, $f_2$, $f_3$, $f_4$, and $f_5$ from the signal source 26 are input to the transducers 21 and 22 of the acoustic optical device 20, respectively.

As described above, according to the embodiment, by addressing the multi electron beam generating apparatus by the light, there are effects such that the wirings to generate electron beam are extremely simplified and the electron beam can be driven in a contactless manner.

What is claimed is:

1. A photoelectric conversion device for electron emission comprising:

an n-type semiconductor region having an electron emission surface for emitting electrons on one side thereof;

a first p-type semiconductor region doped with a p-type impurity of a predetermined concentration being disposed on said n-type semiconductor region at a side opposite of said electron emission surface, said first p-type semiconductor region thereby forming a p-n junction with said n-type semiconductor region;

a second p-type semiconductor region doped with a p-type impurity of a concentration less than the predetermined concentration of said first p-type semiconductor region, said second p-type semiconductor being arranged surrounding said first p-type semiconductor region on one side of said second p-type semiconductor region; and means for applying a reverse bias voltage to the p-n junction, wherein said second p-type semiconductor region has a concave portion, on a side opposite to the side surrounding said first p-type semiconductor region, for receiving incident light.

2. A photoelectric conversion device for electron emission comprising:

a p-type semiconductor region doped with a p-type impurity of a predetermined high concentration;

an n-type semiconductor region disposed on at least a portion of said p-type semiconductor region forming a p-n junction on one side thereof, said n-type semiconductor region having an electron emission surface for emitting electrons at a side opposite to the p-n junction;

at least one region disposed between said n-type semiconductor and said p-type semiconductor, wherein said at least one region comprises a material selected from the group consisting of a non-doped semiconductor and an insulator;

a photoconductive region disposed on said p-type semiconductor region on a side opposite to the side in which the p-n junction is formed; and means for applying reverse bias voltage to the p-n junction.

* * * * *